US008991085B1

(12) United States Patent
Knapp

(10) Patent No.: US 8,991,085 B1
(45) Date of Patent: Mar. 31, 2015

(54) ELECTRICAL WEAPON SYSTEM

(71) Applicant: Raytheon Company, Waltham, MA (US)

(72) Inventor: David J. Knapp, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 100 days.

(21) Appl. No.: 13/736,361

(22) Filed: Jan. 8, 2013

(51) Int. Cl.
*F41B 15/04* (2006.01)
*F41H 13/00* (2006.01)

(52) U.S. Cl.
CPC ..... *F41H 13/0018* (2013.01)
USPC ..... 42/1.08; 361/232

(58) Field of Classification Search
USPC ..... 42/1.08, 1.11; 361/232
See application file for complete search history.

(56) References Cited

U.S. PATENT DOCUMENTS

| | | | | |
|---|---|---|---|---|
| 4,485,426 | A * | 11/1984 | Kerls | 361/232 |
| 4,486,807 | A * | 12/1984 | Yanez | 361/232 |
| 4,843,336 | A * | 6/1989 | Kuo | 340/521 |
| 5,282,332 | A * | 2/1994 | Philips | 42/1.08 |
| 5,379,179 | A * | 1/1995 | Graves | 361/232 |
| 5,487,759 | A * | 1/1996 | Bastyr et al. | 607/149 |
| 6,272,781 | B1 | 8/2001 | Resnick | |
| 6,646,855 | B2 | 11/2003 | Buening et al. | |
| 7,075,770 | B1 * | 7/2006 | Smith | 361/232 |
| 7,290,366 | B2 | 11/2007 | Endres | |
| 7,712,149 | B2 | 5/2010 | Baldwin | |
| 7,746,622 | B2 * | 6/2010 | Young | 361/232 |
| 8,070,703 | B2 * | 12/2011 | Skahan et al. | 602/23 |
| 8,560,077 | B2 * | 10/2013 | Feinstein | 607/48 |
| 2011/0013337 | A1 * | 1/2011 | Brown | 361/232 |
| 2013/0331750 | A1 * | 12/2013 | Liu | 602/2 |

* cited by examiner

*Primary Examiner* — Reginald Tillman, Jr.
(74) *Attorney, Agent, or Firm* — Cantor Colburn LLP

(57) ABSTRACT

An electrical weapon system includes a power supply; a control electronics connected to the power supply; and an electrode pair, wherein the control electronics are configured to deliver a voltage having a determined voltage level and modulation across the electrode pair based on the electrode pair coming into contact with a target, and wherein the electrode pair is integrated into clothing or equipment of a user.

17 Claims, 12 Drawing Sheets

ELECTRICAL WEAPON SYSTEM

BACKGROUND

This disclosure relates generally to weapons systems, and more particularly to an electrical weapon system.

In a close quarters battle (CQB) scenario, a team of personnel, such as soldiers or police, may enter a structure, quickly eliminate any opposition, and capture a target. Close quarters combat requires rapid domination of a room, elimination of the enemy with discriminating fire, gaining and maintaining control of the situation and all personnel in the room, while maintaining security and being able to react to enemy contact. When facing combatants in a CQB scenario, a range of options are available, such as assault rifles, grenades, pistols, knives, and grappling techniques. However, such options may be inappropriate for noncombatants, such as a combatant's wife or children, which may pose a threat and require neutralization. The noncombatants may, for example, grab, block, and distract personnel in the CQB scenario. Pushing away noncombatants may not be effective to neutralize the threat; lethal force may not be appropriate or authorized; and brute force may not be desirable. There are a variety of nonlethal devices available for dealing with noncombatants, including bean bag rounds for a shotgun, active denial, optical and sonic stun devices, and water cannons. However, some drawbacks of such nonlethal devices include potential for confusion with gunfire and sympathetic lethal fire from teammates in the case of bean bag rounds, relatively large size, weight, and/or power requirements, and the need for personnel to switch between lethal and non-lethal weaponry.

SUMMARY

In one aspect, an electrical weapon system includes a power supply; a control electronics connected to the power supply; and an electrode pair, wherein the control electronics are configured to deliver a voltage having a determined voltage level and modulation across the electrode pair based on the electrode pair coming into contact with a target, and wherein the electrode pair is integrated into clothing or equipment of a user.

Additional features are realized through the techniques of the present exemplary embodiment. Other embodiments are described in detail herein and are considered a part of what is claimed. For a better understanding of the features of the exemplary embodiment, refer to the description and to the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

Embodiments of an electrical weapon system are provided, with exemplary embodiments being discussed below in detail. The electrical weapon system may comprise one or more electrical stun devices that are placed at various locations on a user. The electrical stun devices provide an electric shock to a target, such as a noncombatant in a CQB scenario, when placed in contact with the target. In various embodiments, the electrical stun devices may be integrated into shoulder pads, knee pads, a user's clothing, a harness that is worn by the user, and/or any other appropriate equipment of the user, such as a helmet, gun, or boot. The electrical weapon system comprises a hands-free weapon that may be used by personnel (for example, soldiers or police personnel) for neutralization of combatants or noncombatants in close quarters situations. The electrical weapon system enables nonlethal and fast subjugation of an opponent without requiring a weapons switch by the user from a lethal to a nonlethal alternative, such that the user does not need to take their hands off of their weapon. The effectiveness of the user during grappling with an opponent is also improved by the electrical weapon system.

In some embodiments, the electrical stun devices of the electrical weapon system may comprise pressure and/or proximity activated electrodes that deliver a shock to a target when an electrode pair is in contact with the target. In various embodiments, the electrical weapon system may have various selectable shock levels that may be used to dissuade or to incapacitate a target, as desired by the user. The selection of the shock level may be made automatically by the electrical weapon system based on sensor data in some embodiments. For example, a user brushing aside a noncombatant may apply relatively mild, cattle prod-like pulses, while higher pressure associated with a knee kick applied to a target by the user may result in application of an incapacitating voltage level and modulation of current. The electrical discharge comprising the shock that is delivered across the electrodes may also be tuned to achieve a variety of effects. For example, the polarity, voltage, and current across the electrodes may be varied over time so that the electrical shock provided by the electrodes to the target is set to a particular modulation and/or waveform in order to create a desired effect, such as confusing a target's muscles. A pressure-activated electrode deployment mechanism may be incorporated into the electrodes such that a target's clothing may be penetrated by the electrodes and electrical contact made with a target. A conductive fluid may also be used in conjunction with the electrodes to increase electrical contact with a target.

Figure 1:
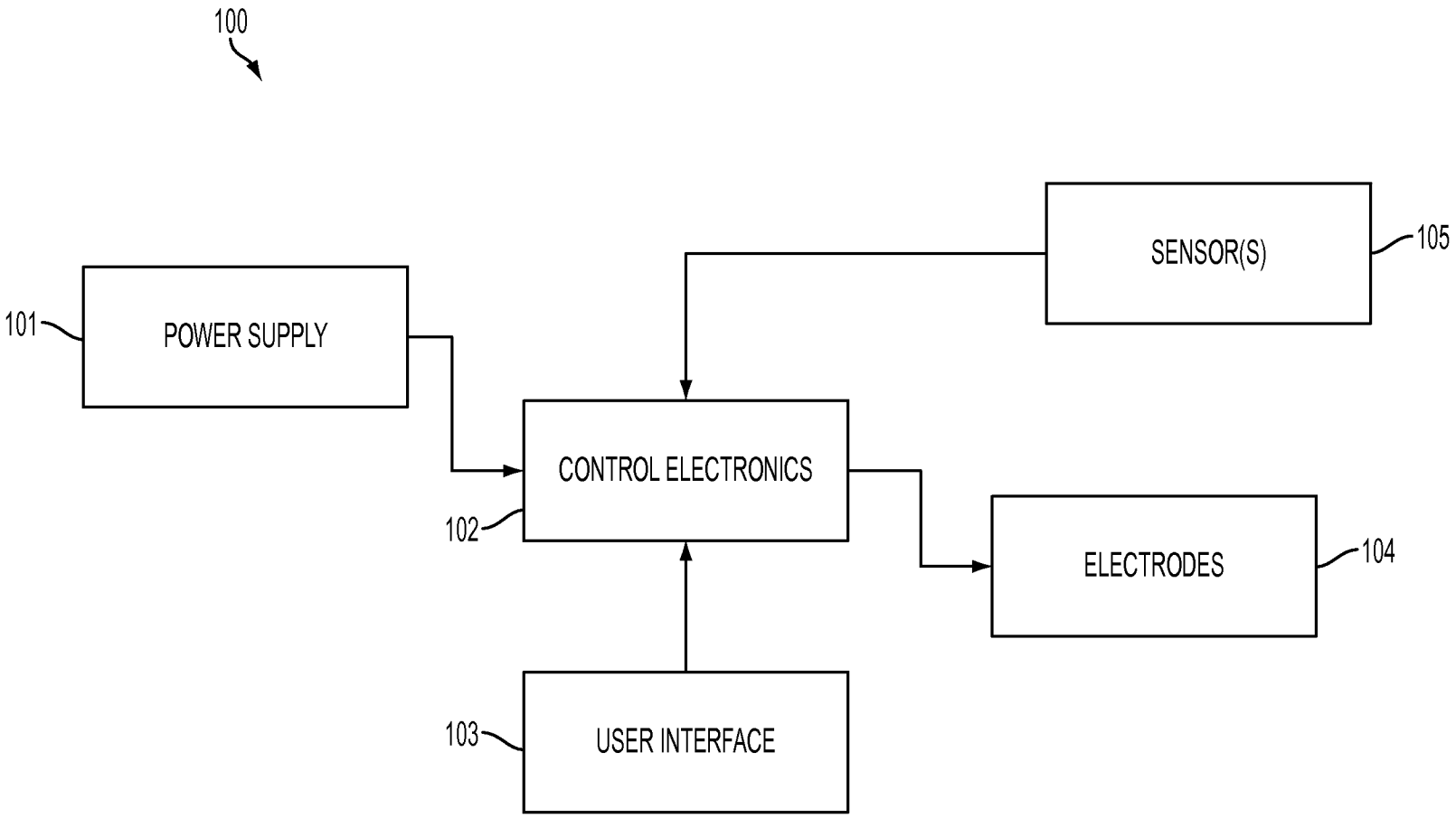
FIG. 1 is a block diagram illustrating an embodiment of an electrical weapon system.

FIG. 1 illustrates an embodiment of an electrical weapon system 100. The electrical weapon system 100 includes control electronics 102, which receives power from power supply 101, in addition to inputs from user interface 103 and sensors 105. The electrodes 104 comprise one or more pairs of electrodes that are controlled by the control electronics 102 and are capable of delivering an electrical shock to a target based on a target coming into contact with the electrodes 104. The power supply 101 provides the electrical power that is used to produce the electrical shock across the electrodes 104 via the control electronics 102. In some embodiments, power supply 101 comprises a battery. The control electronics 102 may use power from the power supply 101 to charge up one or more capacitors, or other appropriate energy storage devices, that are located in the control electronics 102; these capacitors are discharged across the electrodes 104 when the circuit comprising the electrodes 104 is closed via contact of the electrodes 104 with a target. The connection between power supply 101 and control electronics 102, and between control electronics 102 and electrodes 104, comprise physical, wired connections. The one or more pairs of electrodes 104 each comprise a respective cathode and anode; multiple pairs of electrodes 104 may be controlled by single control electronics 102 in some embodiments. In further embodiments that include multiple sets of electrodes 104, one or more sets of electrodes may have respective separate control electronics 102; in such embodiments, the electrical weapon system may include one or more power supplies 101.

User interface 103 allows the user to activate or deactivate the electrical weapon system 100 via control electronics 102. In some embodiments, the user interface 103 may also allow the user to change an operating mode of the electrical weapon system 100. The various operating modes may specify different levels and/or types of shocks that may be delivered by the electrical weapon system 100. User interface 103 may include any appropriate user input interface that provides an input into the control electronics 102, such as an on-off switch, and, in some embodiments, multiple physical switches or buttons that may be used indicate a desired mode of operation by the user to the electrical weapon system 100. User interface 103 may be connected to the control electronics 102 by a physical, wired connection in some embodiments, or, in other embodiments, may be connected to the control electronics via a wireless transmitter that sends signals to a receiver in the control electronics 102. User interface 103 may also comprise a display to indicate to the user a current mode or state of the electrical weapon system 100; the display may comprise, for example, light emitting diodes (LEDs) or any other appropriate display. In some embodiments in which the electrodes 104 that are controlled by the control electronics 102 comprises more than one pair of electrodes, user interface 103 may be used to set the operating modes of the multiple pairs of electrodes to different modes, or turn of one pair while turning another pair on, as desired by the user.

In further embodiments, the control electronics 102 may receive input from one or more sensors 105. The one or more sensors 105 may be used to indicate to the control electronics 102 that, for example, a target is in close proximity to or in contact with the electrodes 104. The connection between the control electronics 102 and any of the one or more sensors 105 may be wired or wireless in various embodiments. The state or operating mode of the electrical weapon system 100 may be determined automatically by the control electronics 102 based on input from the one or more sensors 105. The one or more sensors 105 may include, in various embodiments, one or more of a buddy safe sensor, an optical sensor, a pressure sensor, an electrical sensor, an inductive sensor, an environmental conditions sensor, and a resistance measurement sensor. Any appropriate number and type of sensors 105 may be incorporated into various embodiments of an electrical weapon system 100. The control electronics 102 may automatically activate, deactivate, and/or adjust an operating mode of the electrical weapon system 100 based on input from the one or more sensors 105. In embodiments of electrical weapon system 100 that include multiple control electronics 102, one or more of the sensors 105 may be in communication with more than one set of control electronics 102.

Some example sensor types that may comprise the one or more sensors 105 are discussed below. A buddy safe sensor may comprise proximity sensor that determines that a subject that is in contact with or near the electrodes 104 is a "friendly" and should not be shocked via electrodes 104. This determination may be made by the buddy safe sensor based on, for example, a radiofrequency identification (RFID) tag that is carried by a non-opponent, such as another soldier or police personnel. Input from a buddy safe sensor may be used to control electronics 102 to deactivate the electrical weapon system 100. The buddy safe sensor may have a relatively short distance range in some embodiments. An optical sensor may be used to indicate that a target is in close proximity to the electrodes 104, and may comprise a passive sensor that measures light in some embodiments. When the light detected by the optical sensor is blocked, the optical sensor may determine that a target is blocking the light, and may, for example, indicate to the control electronics 102 that the electrical weapon system 100 should be activated. An optical sensor may be located in close proximity to a pair of electrodes 104; in embodiments of the electrical weapon system 100 comprising multiple pairs of electrodes 104, each pair of electrodes 104 may be associated with a respective optical sensor. In some embodiments, an optical sensor for use in an electrical weapon system 100 may comprise an infrared sensor that may be used to detect the presence of a warm body. A pressure sensor may be integrated into a respective pair of the electrodes 104. Force on a pressure sensor may indicate that the pressure sensor's respective electrodes 104 have made physical contact with a target. The pressure sensor may comprise a piezoelectric sensor that converts pressure into an electrical charge. Different pressure levels that are detected by a pressure sensor may cause the control electronics 102 to change between operating modes (i.e., shock level and/or type). For instance, a relatively low pressure may result in a cattle prod-like low voltage shock, while a relatively high pressure that indicates, for example, a kick by the user, may result in that a higher-voltage modulated shock that may confuse a target's muscle signals. In further embodiments, data from a pressure sensor may cause the electrodes 104 to be deployed such that the electrodes may penetrate the target's clothing, or may cause an electrically conductive liquid to be dispensed onto the target. An electrical sensor may measure the voltage, current, and/or capacitance across two cathodes to determine that the electrodes 104 are in electrical contact with a target. This information may be used to put the electrical weapon system 100 into a particular shock mode. The cathodes that comprise an electrical sensor may be separate from the electrodes 104, or the same as the electrodes 104 in various embodiments. Input from an inductive sensor may cause the control electronics 102 to deactivate the electrical weapon system 100 in the presence of a metallic target, such that the electrodes 104 are not discharged across a metallic object, which may short circuit the electrical weapon system 100. An environmental conditions sensor allows for automatic disabling of the electrical weapon system 100 by control electronics 102 when, for example, precipitation or other environmental factors might short circuit the electrodes 104.

A resistance measurement sensor may be used by the control electronics 102 to select two electrodes of a plurality of electrodes in the electronic weapon system 100 as the electrode pair for delivering the shock. The resistance measurement sensor may measure respective resistances across all possible electrode pairs in the electrical weapon system 100, and the control electronics 102 may select any two electrodes of the plurality of electrodes as the electrode pair for delivering the shock to the target based on the plurality of resistance measurements. A relatively high resistance between two electrodes may indicate that the two electrodes are not both in contact with a suitable target, while a relatively low resistance between two electrodes may indicate that two electrodes are shorted (a short between two electrodes may be caused, for example, by a conductive fluid that closes a gap between electrodes, such as is discussed below with respect to FIGS. 5*a-b*). High and low resistance thresholds may be set to prevent two inappropriate electrodes from being selected by control electronics 102 as the electrode pair for delivering the shock to the target. Resistance measurements from the resistance measurement sensor may also indicate that two electrodes with a relatively low resistance between them may be combined electrically into a single anode or cathode for use in conjunction with another anode or cathode to deliver a relatively high shock to a target. For example, a knee kick by the user against a target may cause two electrodes k1 and k2 to come in contact with the target, and a simultaneous elbow strike by the user against the target with two electrodes e1 and e2. The electrodes k1, k2, e1, and e2 may each comprise a conductive fluid delivery system such as is discussed below with respect to FIGS. 5*a-b*, and the conductive fluid may short k1 and k2 together, and also short e1 and e2 together. Based on the resistance measurement sensor, the control electronics 102 may select k1 and k2 as a first electrode of the electrode pair for delivering the shock, and e1 and e2 and the second electrode of the electrode pair.

In one embodiment, the control electronics 102 include a capacitor that is charged using power from a battery that comprises the power supply 101; an open circuit including two electrodes 104 hooked up to each terminal of the capacitor; and a user interface 103 comprising an on/off switch. In some embodiments, the control electronics 102 may further include a circuit that changes the polarity of the electrodes 104 over time, resulting in a modulated shock. In further embodiments the control electronics 102 may include a switchable bank of capacitors so that as one capacitor is discharged, another charged capacitor may be connected to the electrodes 104.

Figure 2:
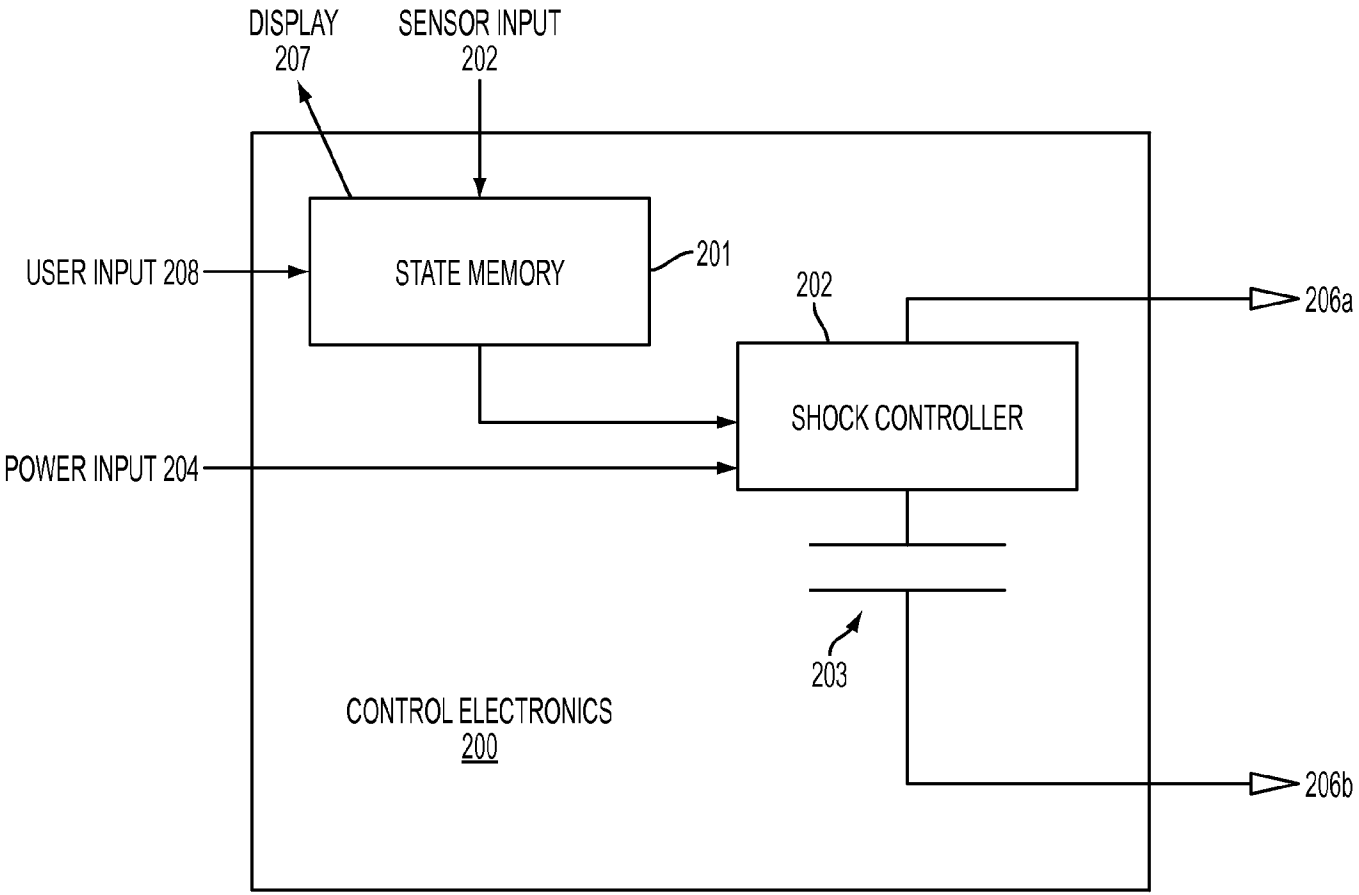
FIG. 2 is a block diagram illustrating an embodiment of control electronics for an electrical weapon system.

An embodiment of control electronics 102 of FIG. 1 is shown in additional detail in FIG. 2. Control electronics 200 of FIG. 2 may be used in conjunction with some embodiments of an electrical weapon system 100. FIG. 2 is discussed with respect to FIG. 1. Display 207 and user input 208 of FIG. 2 comprise connections to a user interface 103 as is shown in FIG. 1. The control electronics 200 communicate to the user via display 207 a state (for example, activated or deactivated), and, in some embodiments, a current mode of operation (for example, a shock level and/or type) of the electrical weapon system 100. Display 207 may comprise LEDs or any other appropriate display. The state and mode of operation of the electrical weapon system 100 may be changed by the user via user input 208. The state and, in some embodiments, the mode of operation of the electrical weapon system 100 are stored in state memory 201. In some embodiments in which the control electronics 200 are in communication with multiple pairs of electrodes, each pair of electrodes may have a separate respective state and mode of operation stored in state memory 201. The control electronics 200 are also in communication with sensor input 205, which may be connected to any appropriate number of the sensor types that were described above with respect to one or more sensors 105 of FIG. 1. The state and mode of operation data that is stored in state memory 201 may be changed automatically by control electronics 102 based on information from the one or more sensors 105 received via sensor input 205.

Some examples of state data that may stored in state memory 201 may include an off state, indicating that the electrical weapon system 100 is turned off; a disarmed state, indicating that the electrical weapon system 100 is turned on but disarmed and will not deliver a shock across electrodes 206*a-b*; a standby state, indicating that capacitor 203 is charged, but the electrical weapon system 100 is disarmed and will not deliver a shock across electrodes 206*a-b*; a charging state, which indicates that the electrical weapon system 100 is charging the capacitor 203; and an armed state, indicating that the electrical weapon system 100 is fully charged and ready to deliver a shock across electrodes 206*a-b*. There may also be various shock modes available, which may vary in intensity and modulation. For example, a first shock mode may be an unmodulated, relatively low voltage that is painful, but not incapacitating to a target; a second shock mode may be a relatively low voltage that is modulated so as to disrupt the target's nervous system; and a third shock mode may be a relatively high and modulated voltage, that is configured to interfere with heart electrical signal and which may be lethal to the target. The control electronics 200 may switch between the various states and shock modes based on input from user input 208 and from sensor input 205.

The control electronics 200 receive power from the power supply 101 via power input 204. The power from power input 204 may be used to and charge up one or more capacitors, such as capacitor 203. The capacitor 203 may be discharged by shock controller 202 to provide a voltage across the electrodes 206*a-b* and pass current into a target that is in contact with the electrodes 206*a-b*. The shock controller 202 may also vary the polarity, voltage, and current across the electrodes 206*a-b* over time so that the electrical shock provided to a target via the electrodes 206*a-b* is set to a desired modulation and/or waveform in order to create a desired effect. The shock controller 202 may be controlled based on state and/or mode of operation data from the state memory 201. While only one set of electrodes 206*a-b* and corresponding capacitor 203 are shown in FIG. 2, in various embodiments, control electronics 200 may control any appropriate number of electrode pairs such as electrodes 206*a-b*, and may include any appropriate number of capacitors or other energy storage devices. In some embodiments, multiple capacitors may be present in control electronics 200, allowing connection of a second capacitor to an electrode pair after a first capacitor is discharged.

The electrodes 104/206*a-b* are the interface from the electrical weapon system 100 to the target. The electrodes 104/206*a-b* comprise one or more cathode and anode pairs. The electrodes are spaced apart by at least a relatively small distance, such as an inch, such that the electrodes 104 do not short out by contacting each other. Instead, contact is made on a target so that the target closes the circuit between the two electrodes 104/206*a-b*. In further embodiments, a pair of electrodes 104/206*a-b* may be relatively widely spaced, or located on different areas of a user; for example, one electrode of a pair may be on a glove, and the other electrode of the pair may be on a boot. In some embodiments, the control electronics 102/200 may rapidly switch between which of the electrodes 104/206*a-b* is positive (cathode) and which is negative (anode) in order to provide an alternating current to the target. Electrodes 104/206*a-b* may be sharp in some embodiments to penetrate clothing or skin in order to make better electrical contact with the target. However, electrodes 104/206*a-b* that deliver relatively high voltage may be effective even if clothing is not penetrated.

Figure 3C:
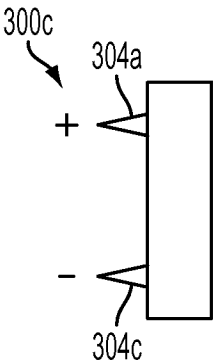
FIGS. 3*a-c* illustrate embodiments of electrodes for an electrical weapon system.
Figure 3B:
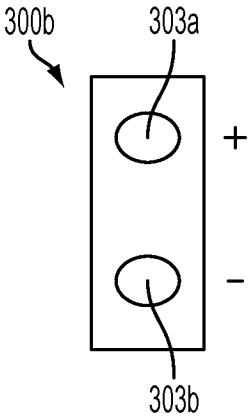
Figure 3A:
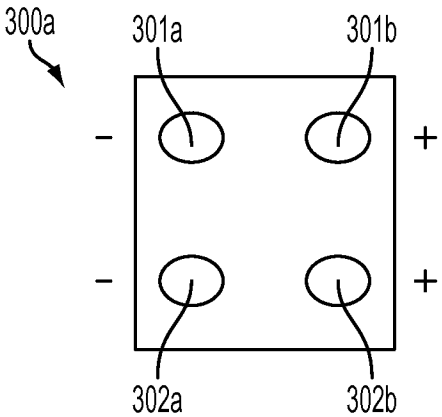

Various embodiments of electrodes, which may comprise any of electrodes 104/206*a-b* of FIGS. 1 and 2, are shown in FIGS. 3*a-c*, FIGS. 4*a-b*, and FIGS. 5*a-b*. FIG. 3*a* shows a front view of an electrode array 300*a* comprising two electrode pairs, including anodes 301*a* and 302*a*, and cathodes 301*b* and 302*b*. FIG. 3*b* shows a front view of an electrode array 300*b* comprising a single electrode pair, including cathode 303*a* and anode 303*b*. FIG. 3*c* shows a side view of an electrode array 300*c* including cathode 304*a* and anode 304*b*. The electrodes 301*a-b*, 302*a-b*, 303*a-b*, and 304*a-b* as shown in FIGS. 3*a-c* may be relatively sharp in some embodiments to allow penetration of a target's clothing, allowing improved electrical contact.

Figure 4B:
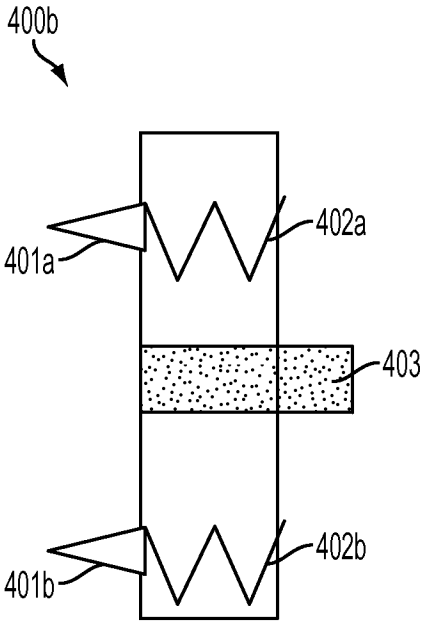
FIGS. 4*a-b* illustrate embodiments of spring-loaded electrodes for an electrical weapon system.
Figure 4A:
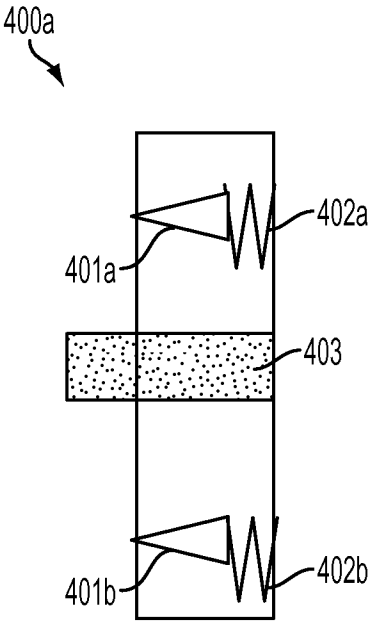

In some embodiments, the electrodes 104/206*a-b* may be spring loaded to deploy when a physical or electrical trigger is initiated; this is illustrated with respect to FIGS. 4*a-b*. FIG. 4*a* shows an undeployed spring-loaded electrode array 400*a* including electrodes 401*a-b* with spring loading mechanism 402*a-b* and trigger 403. FIG. 4*b* shows the electrode array 400*a* after deployment of the electrodes 401 *a-b* by spring loading mechanism 402*a-b*. A trigger such as trigger 403 causes the electrical weapon system 100 to mechanically release the spring loaded electrodes 401*a-b* via spring loading mechanism 402*a-b*. The trigger 403 may comprise an electrical trigger comprising an electro-mechanical switch in some embodiments, to release the spring loaded electrodes 401*a-b* when a command from the control electronics 102/200 is received. This command might be initiated by control electronics 102/200 upon the receipt of notification from a sensor of sensors 105 that a target is in close proximity to the electrodes 401*a-b*. In other embodiments, the trigger 403 may comprise a physical trigger such as pressure sensor that directly deploys the electrodes 401*a-b* when physical pressure is experienced by the trigger 403.

Figure 5B:
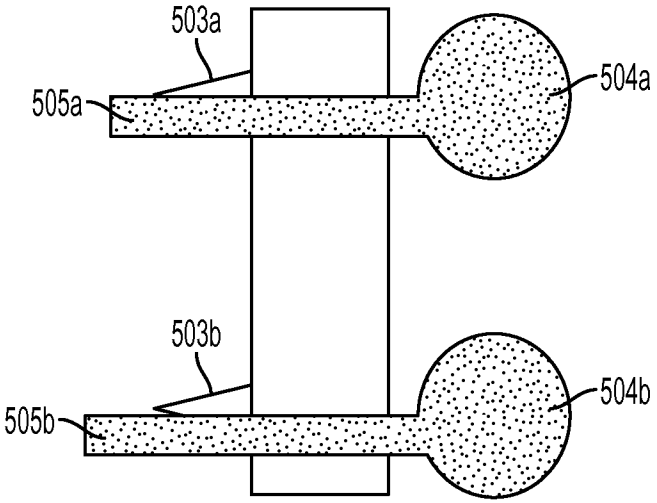
FIGS. 5*a-b* illustrate embodiments of electrodes including a conductive liquid solution for an electrical weapon system.
Figure 5A:
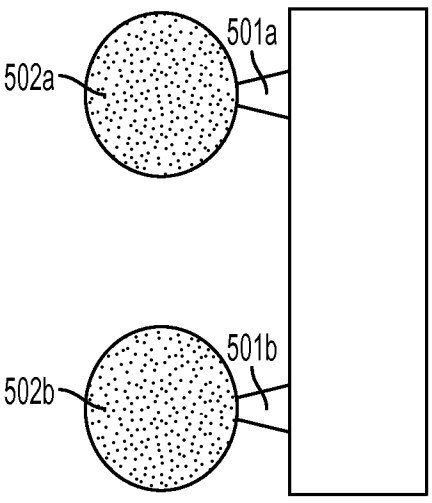

In further embodiments, an electrically conductive fluid, such as, but not limited to, salt water, may be used in conjunction with the electrodes 104/206*a-b* to reduce electrical resistance between the electrodes 104/206*a-b* and a target; this is illustrated with respect to FIGS. 5*a-b*. FIG. 5*a* shows an embodiment of an electrode array 500*a* including electrodes 501*a-b* with capsules 502*a-b* that hold an electrically conductive fluid. Physical force between the electrodes 501*a-b* and a target breaks the capsules 502*a-b* and releases the electrically conductive fluid, allowing the electrically conductive fluid in the capsules 502*a-b* to penetrate the clothing and contact the skin of the target. This reduces the electrical resistance between the electrodes 501*a-b* and the target, and increases the effectiveness of the electrical shock delivered by the electrodes 501*a-b*. FIG. 5*b* shows an embodiment of an electrode array 500*b* in which the electrically conductive fluid is held in reservoirs 504*a-b* behind the electrodes 503*a-b*. Contact between the target and the electrodes 503*a-b* may squeeze, or actuate a pumping mechanism in, the reservoirs 504*a-b*, causing the reservoirs 504*a-b* to dispense the electrically conductive fluid via liquid exit apertures 505*a-b* onto the target at points that are in electrical contact with the electrodes 503*a-b*. The liquid exit apertures 505*a-b* may be metallized so that they are part of the electrodes 503*a-b* in some embodiments, or in other embodiments, the liquid exit apertures may be in close proximity with the electrodes 503*a-b* but not integrated with the electrodes 503*a-b*. Conductive fluids, such as are held in capsules 502*a-b* or reservoirs 504*a-b*, allow use of relatively blunt electrodes to achieve good electrical contact with a target, avoiding physical damage to the target that may occur with sharp electrodes. Capsules 502*a-b* or reservoirs 504*a-b* are shown for illustrative purposes only; any appropriate mechanism may be used to dispense an electrically conductive fluid in conjunction with any appropriate type of electrodes in an electrical weapon system 100. In further embodiments, a mechanism for dispensing an electrically conductive fluid, including but not limited to capsules 502*a-b* or reservoirs 504*a-b*, may be used in conjunction with spring-loaded electrodes as were shown in FIGS. 4*a-b*.

Figure 6:
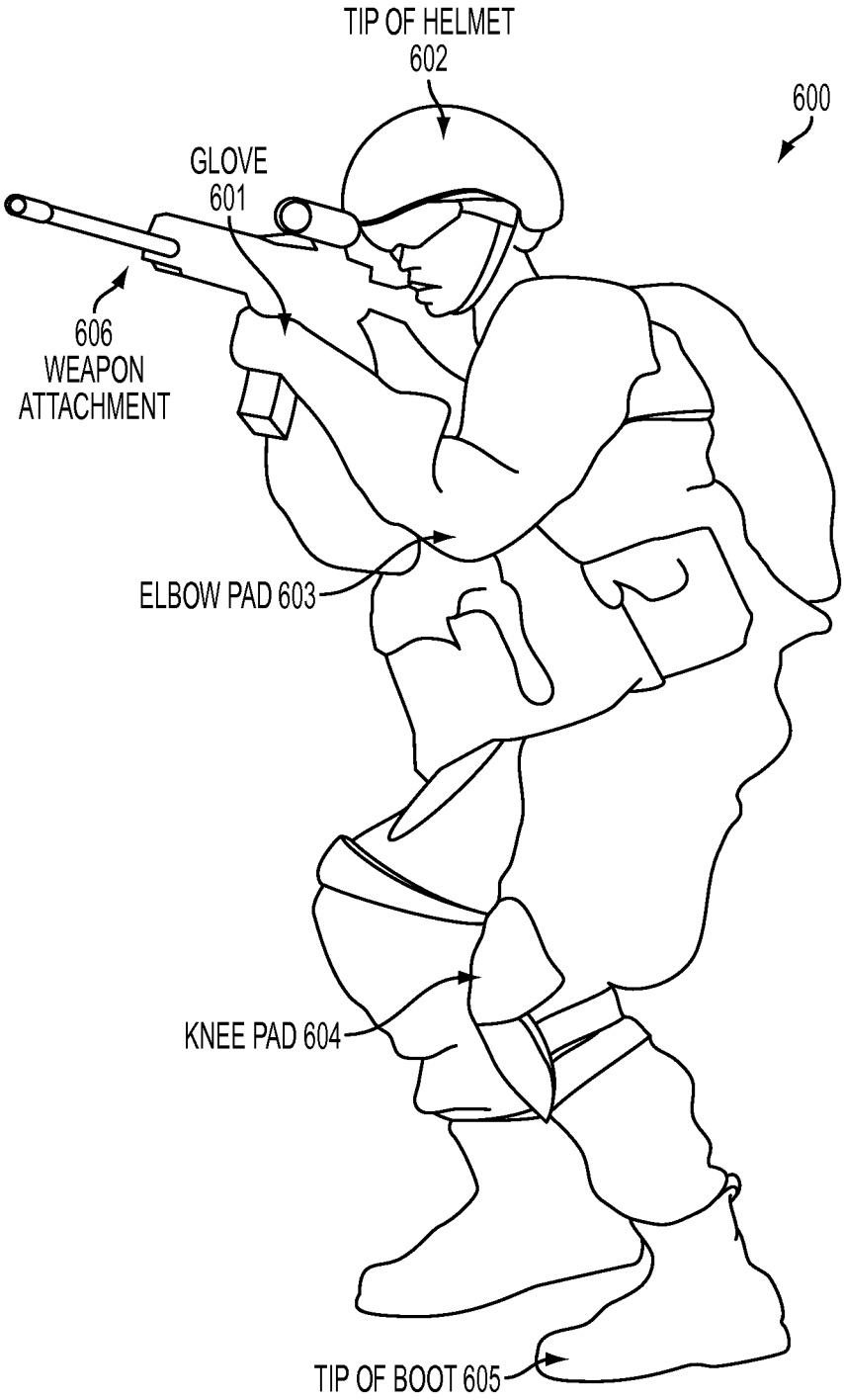
FIG. 6 illustrates an embodiment of a user with an electrical weapon system.

Electrodes, which may comprise any of the electrodes shown or discussed above with respect to FIG. 1-2, 3*a-c*, 4*a-b*, or 5*a-b*, may be integrated into any appropriate locations on a user's clothing or equipment. Some example electrode location points on a user 600 that comprises a soldier are illustrated with respect to FIGS. 6-12; these electrode location points may be used in conjunction with any appropriate user. FIG. 6 is discussed with respect to FIG. 1. FIG. 6 illustrates an user 600 that is wearing an electrical weapon system 100 that includes a plurality of electrode location points, including glove 601, tip of helmet 602, elbow pad 603, knee pad 604, tip of boot 605, and weapon attachment 606. FIG. 6 is shown for illustrative purposes only; electrodes may be places in any appropriate location on a user 600. Each set of electrodes at locations 601-606 is physically and electrically connected to a set of control electronics 102 and a power supply 101, while connections between the control electronics 102 and the user interface 103, and the control electronics 102 and any sensors 105, may be wired and/or wireless in various embodiments. In some embodiments, a harness that is worn by the user may connect multiple sets of electrodes located at different locations on the user with a common set of control electronics 102 and/or power supply 101. In other embodiments, various sets of electrodes at the various location point 601-606 may have separate control electronics 102 and/or power supply 101. One or more sensors 105 may also be located at any appropriate location on user 600. In embodiments in which the electrical weapon system 100 includes multiple sets of control electronics 102, one or more of the sensors 105 may be in communication with one or more sets of the control electronics 102. In some embodiments, a harness for an electrical weapon system 100 may be sewn into a uniform worn by user 600 so that wires comprising the harness do not snag. In other embodiments an electrical harness comprising an electrical weapon system 100 may be built into straps that attach equipment to the user 600. This allows removal of the electrical weapon system 100 and use with other uniforms after a given uniform wears out. In further embodiments, the harness comprising the electrical weapon system 100 may be self-contained within a monolithic unit, such as a "stun bayonet" that may be attached to a weapon, such as weapon attachment 606.

Figure 7:
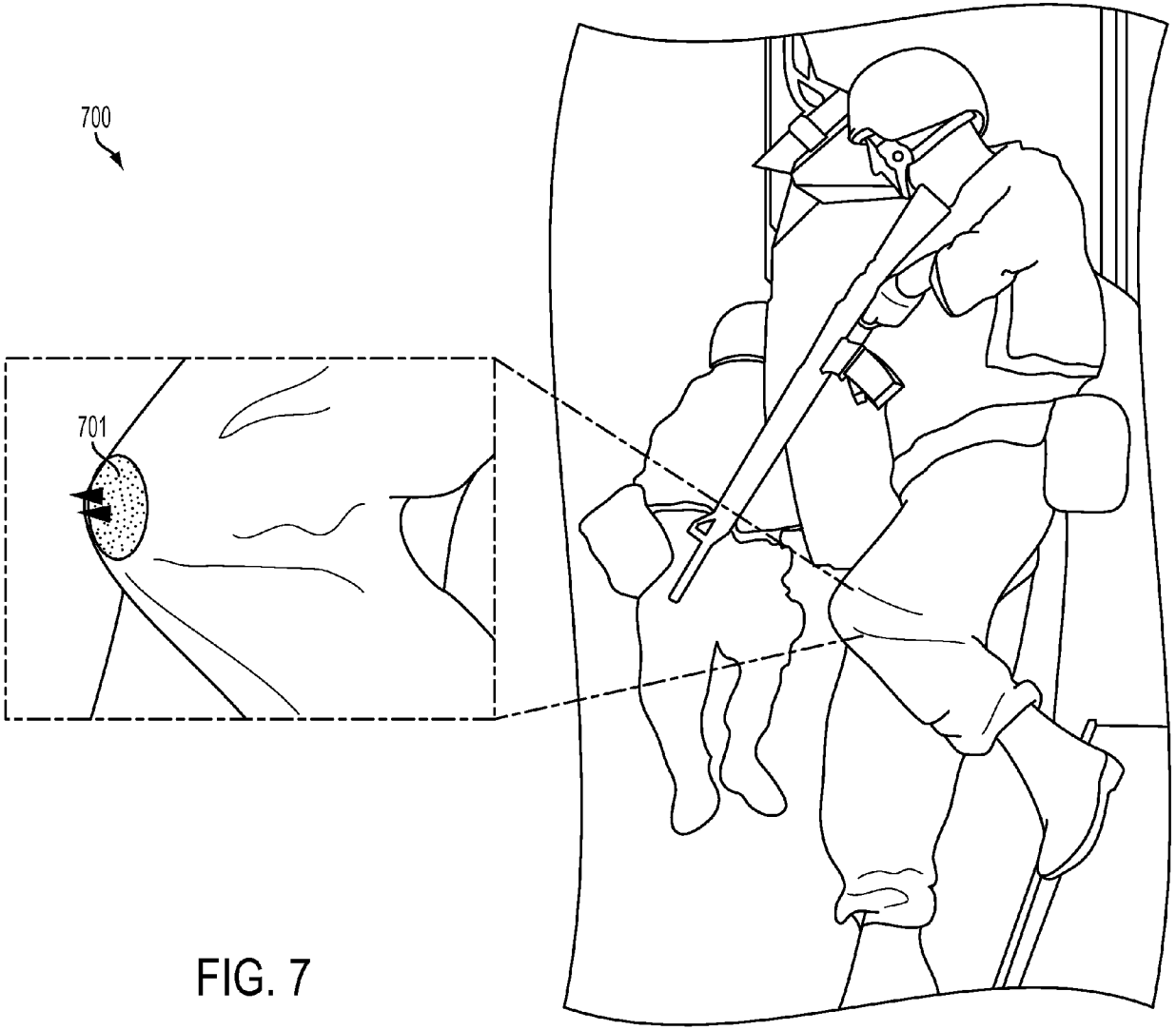
FIGS. 7-12 illustrate electrode locations for an electrical weapon system according to various embodiments.

FIG. 7 shows a knee pad electrode system 700, which may be part of an electrical weapon system 100, including a set of electrodes 701 that are located on a knee pad, which may provides a stiff backing which allows for the electrodes to be thrust into an opponent with a knee kick. Electrodes 701 may comprise any of the electrodes shown or discussed above with respect to FIG. 1-2, 3*a-c*, 4*a-b*, or 5*a-b*. Electrodes 701 may comprise a single electrode pair in some embodiments, or multiple electrodes pairs in other embodiments. In various embodiments, knee pad electrode system 700 may comprise a respective set of control electronics 102, or may share a set of control electronics 102 with another set of electrodes in the electrical weapon system 100.

Figure 8:
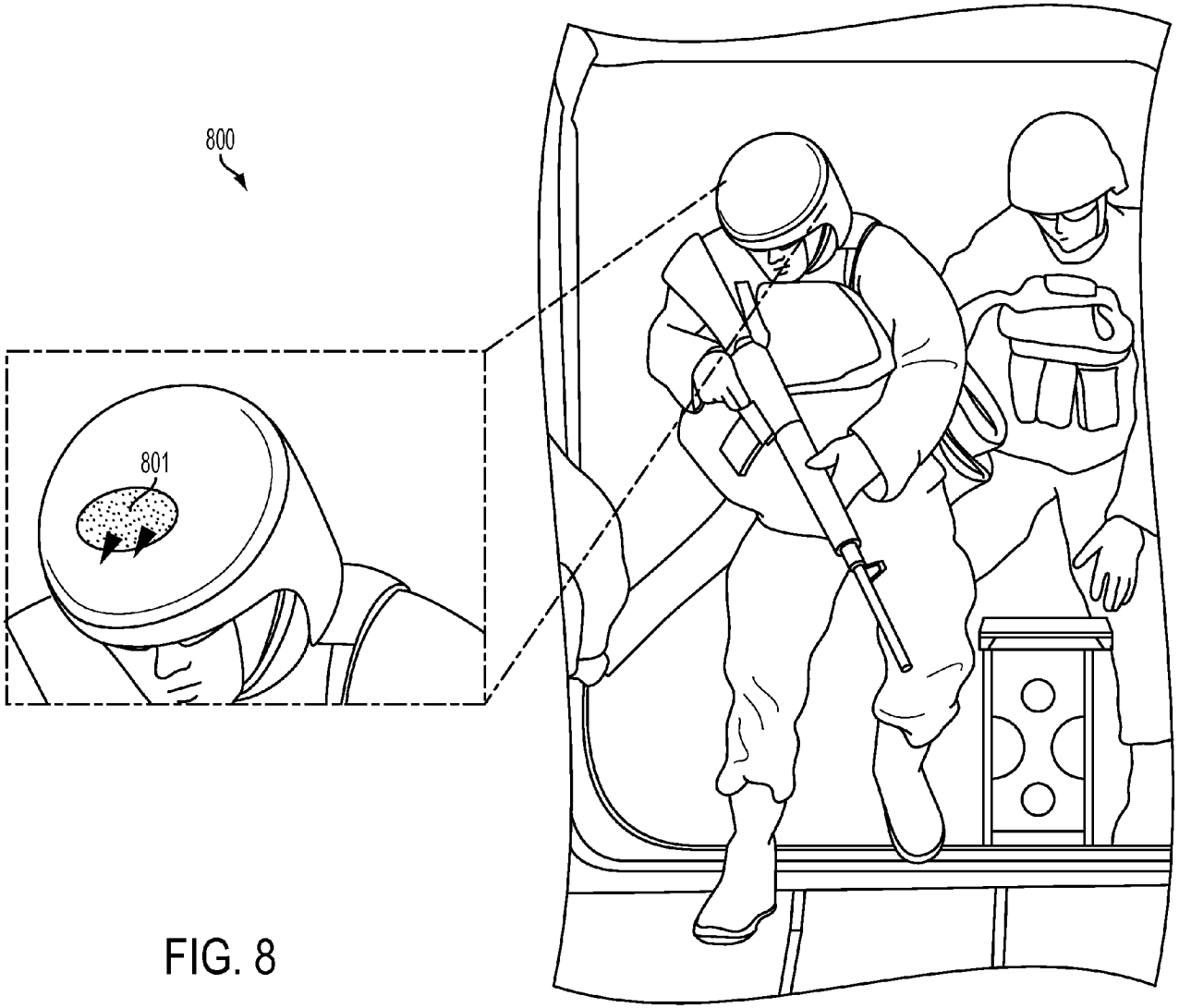

FIG. 8 shows a helmet electrode system 800, which may be part of an electrical weapon system 100, including a set of electrodes 801 that are integrated into a helmet or worn as an attachment to the helmet. Electrodes 801 may comprise any of the electrodes shown or discussed above with respect to FIG. 1-2, 3*a-c*, 4*a-b*, or 5*a-b*. Electrodes 801 may comprise a single electrode pair in some embodiments, or multiple electrodes pairs in other embodiments. In various embodiments, helmet electrode system 800 may comprise a respective set of control electronics 102, or may share a set of control electronics 102 with another set of electrodes in the electrical weapon system 100.

Figure 9:
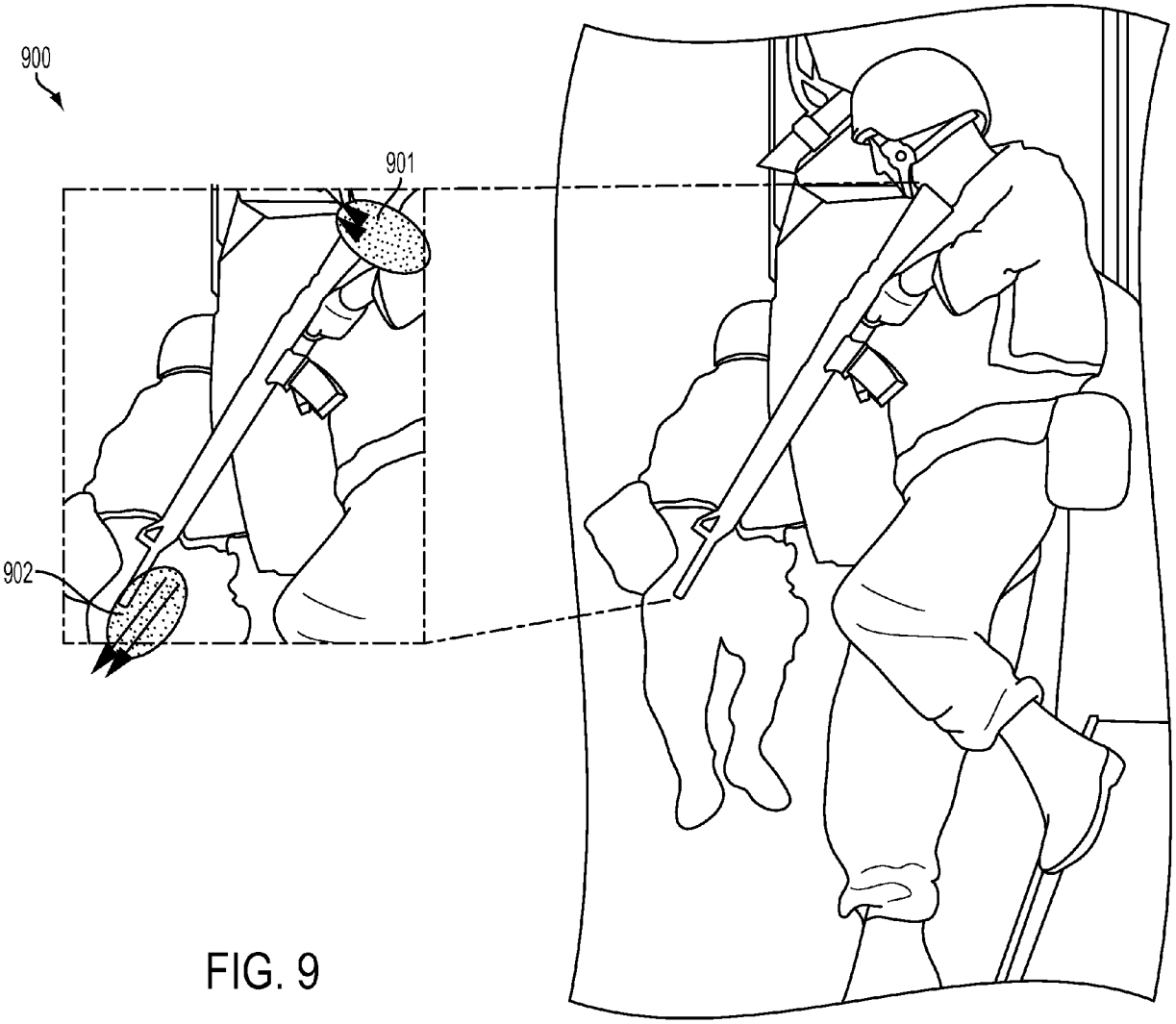

FIG. 9 shows a weapon electrode system 900, which may be part of an electrical weapon system 100, including sets of electrodes 901 and 902 that are attached to a weapon. Electrodes 901 and 902 may comprise any of the electrodes shown or discussed above with respect to FIG. 1-2, 3*a-c*, 4*a-b*, or 5*a-b*. Electrodes 901 and 902 may each comprise single electrode pairs in some embodiments, or multiple electrodes pairs in other embodiments. In various embodiments, weapon electrode system 900 may comprise a respective set of control electronics 102 that controls electrodes 901 and 902, or may share a set of control electronics 102 with another set of electrodes in the electrical weapon system 100. The attachment mechanism for electrodes 902 may be similar to the mounting mechanism on a bayonet to hold the electrodes 902 in position in front of the barrel of the weapon for a forward stabbing motion to obtain electrical contact with a target. In some embodiments, a weapon electrode system 900 may further include electrodes that are located on the side of a weapon to enable electrical contact with sweeping motions of the rifle, or on the stock of the rifle for rifle butting motions. FIG. 9 is shown for illustrative purposes only; a weapon electrode system 900 may comprise only one of sets of electrodes 901 or 902 in some embodiments.

Figure 10:
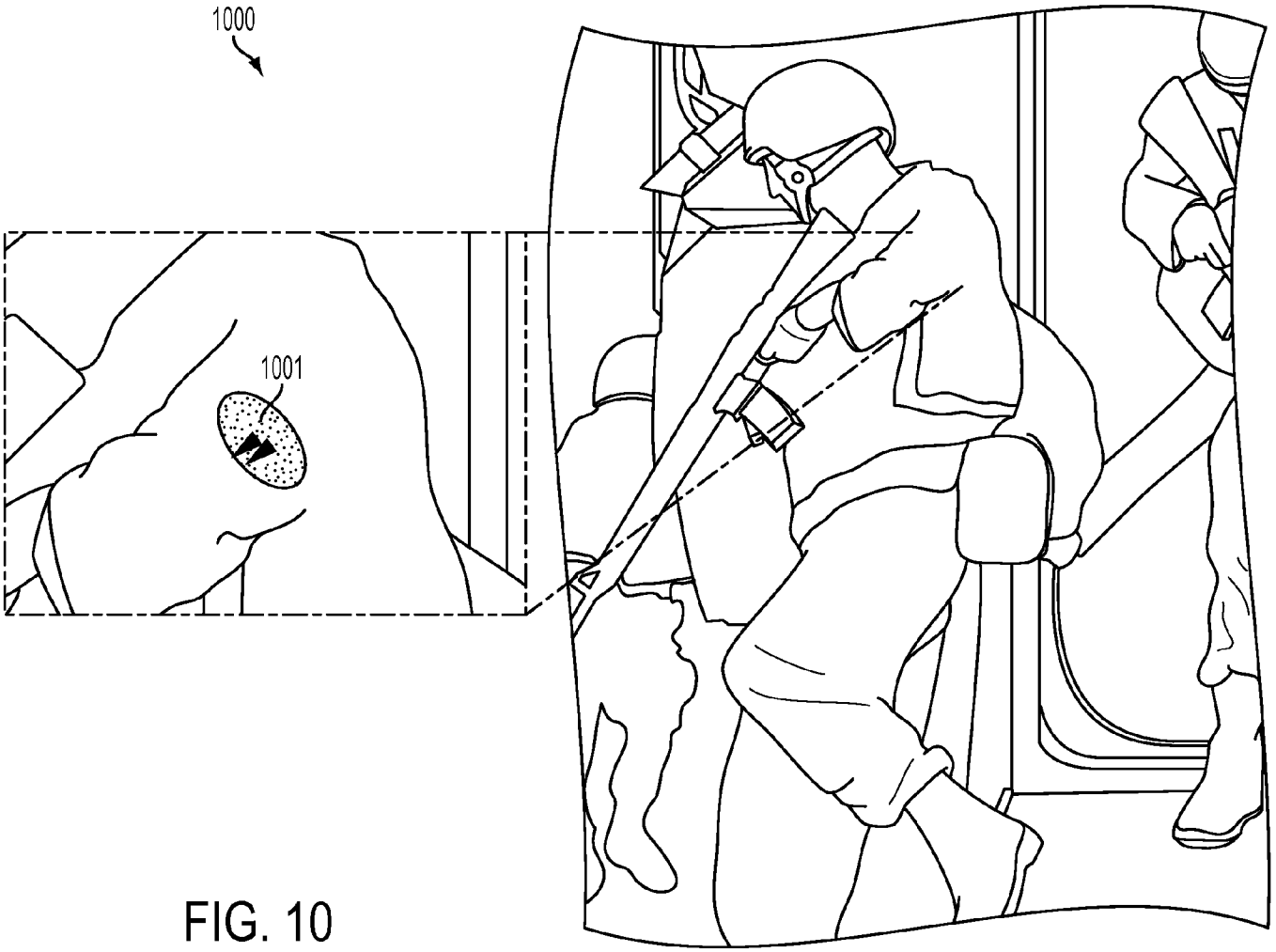

FIG. 10 shows an elbow pad electrode system 1000, which may be part of an electrical weapon system 100, including a set of electrodes 1001 that are integrated into an elbow pad that is worn by the user. Contact may be made between the electrodes 1001 and a target with an elbow strike, which may be used in situation having limited space to complete a striking motion. Electrodes 1001 may comprise any of the electrodes shown or discussed above with respect to FIG. 1-2, 3*a-c*, 4*a-b*, or 5*a-b*. Electrodes 1001 may comprise a single electrode pair in some embodiments, or multiple electrodes pairs in other embodiments. In various embodiments, elbow pad electrode system 1000 may comprise a respective set of control electronics 102, or may share a set of control electronics 102 with another set of electrodes in the electrical weapon system 100.

Figure 11:
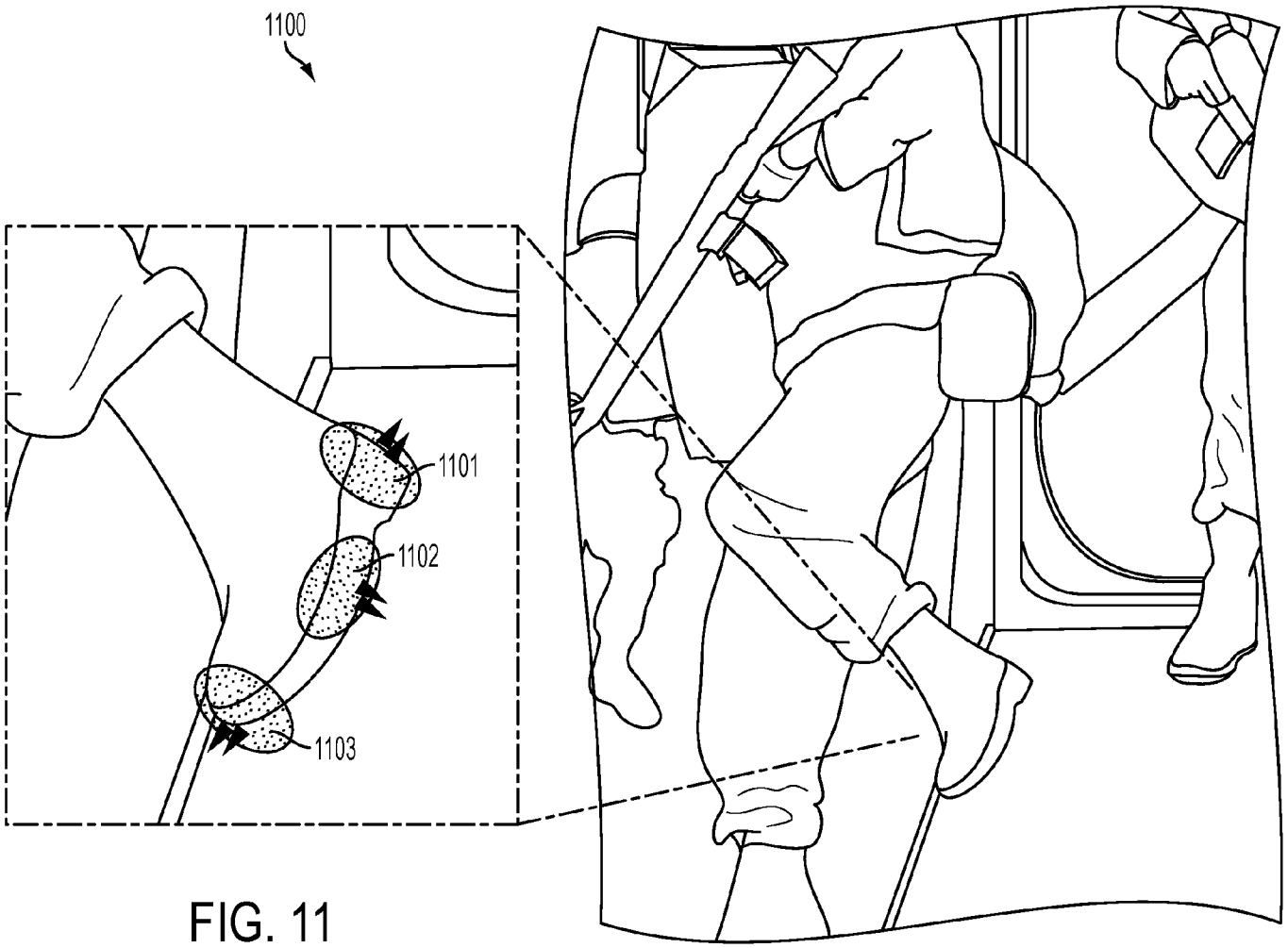

FIG. 11 shows a boot electrode system 1100, which may be part of an electrical weapon system 100, including sets of electrodes 1101, 1102, and 1103 that are placed on the hee1, edge, and toe of a boot, respectively. Boot electrode system 1100 allows the user to make contact by kicking the target while maintaining one or both hands on the primary weapon such as a rifle, and also allow for contact against a target when arms are engaged in grappling. Electrodes 1101, 1102, and 1103 may comprise any of the electrodes shown or discussed above with respect to FIG. 1-2, 3*a-c*, 4*a-b*, or 5*a-b*. Electrodes 1101, 1102, and 1103 may each comprise a single electrode pair in some embodiments, or multiple electrodes pairs in other embodiments. In various embodiments, helmet electrode system 800 may comprise a respective set of control electronics 102, or may share a set of control electronics 102 with another set of electrodes in the electrical weapon system 100. FIG. 11 is shown for illustrative purposes only; a boot electrode system 1100 may comprise only one of sets of electrodes 1101, 1102, or 1103 in some embodiments.

Figure 12:
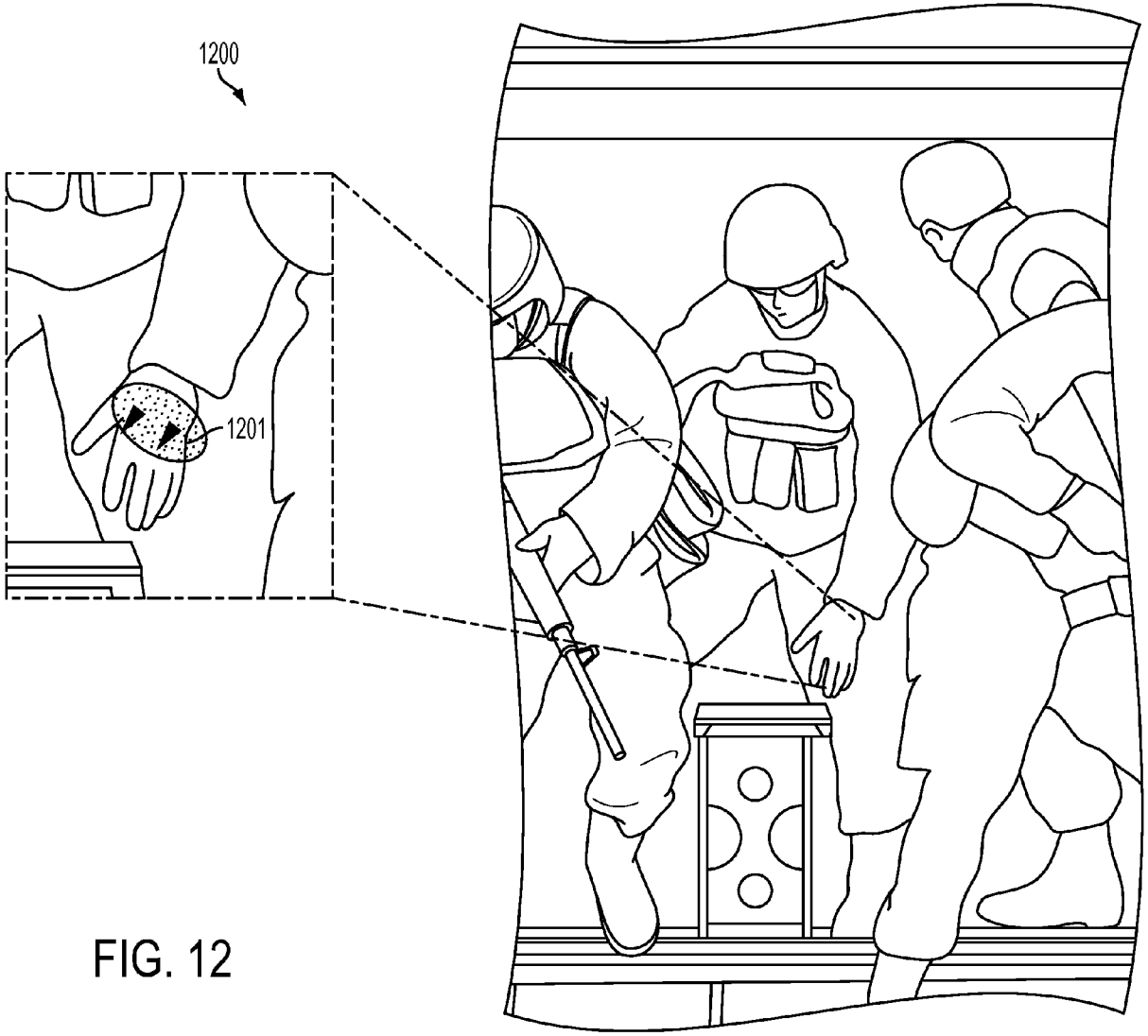

FIG. 12 shows a glove electrode system 1200, which may be part of an electrical weapon system 100, including a set of electrodes 1201 that are integrated into a user's glove. Electrodes 1201 may comprise any of the electrodes shown or discussed above with respect to FIG. 1-2, 3*a-c*, 4*a-b*, or 5*a-b*. Electrodes 1201 may comprise a single electrode pair in some embodiments, or multiple electrodes pairs in other embodiments. In various embodiments, glove electrode system 1200 may comprise a respective set of control electronics 102, or may share a set of control electronics 102 with another set of electrodes in the electrical weapon system 100.

The technical effects and benefits of exemplary embodiments include increased effectiveness of a user, such as a soldier or police personnel, during close quarters combat and increased effectiveness in dealing with noncombatants by the provision of additional nonlethal effects.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An electrical weapon system, comprising:

a power supply;

a control electronics connected to the power supply; and an electrode pair, wherein the control electronics are configured to deliver a voltage having a desired voltage level and modulation across the electrode pair based on the electrode pair coming into contact with a target, and wherein the electrode pair is integrated into clothing or equipment of a user.

2. The system of claim 1, wherein the electrode pair is integrated into a knee pad.

3. The system of claim 1, wherein the electrode pair is integrated into a helmet.

4. The system of claim 1, wherein the electrode pair is integrated into a rifle.

5. The system of claim 1, wherein the electrode pair is integrated into an elbow pad.

6. The system of claim 1, wherein the electrode pair is integrated into a boot.

7. The system of claim 1, further comprising a buddy safe sensor in communication with the control electronics, and wherein the control electronics are configured to disable the electrical weapon system based on input from the buddy safe sensor.

8. The system of claim 1, further comprising an optical sensor in communication with the control electronics, and wherein the control electronics are configured to deliver the voltage at the desired voltage level and modulation based on input from the optical sensor.

9. The system of claim 1, further comprising a pressure sensor in communication with the control electronics, and wherein the control electronics are configured to deliver the voltage at the desired voltage level and modulation based on input from the pressure sensor.

10. The system of claim 9, wherein the control electronics are further configured to automatically determine at least one of the voltage level and the degree of modulation that is delivered to the target via the electrode pair based on input from the pressure sensor.

11. The system of claim 1, further comprising an electrical sensor in communication with the control electronics, and wherein the control electronics are configured to deliver the voltage at the desired voltage level and modulation based on input from the electrical sensor.

12. The system of claim 1, further comprising an inductive sensor in communication with the control electronics, and wherein the control electronics are configured to disable the electrical weapon system based on input from the inductive sensor.

13. The system of claim 1, further comprising an environmental conditions sensor in communication with the control electronics, and wherein the control electronics are configured to disable the electrical weapon system based on input from the environmental conditions sensor.

14. The system of claim 1, wherein the electrode pair is spring loaded, and wherein the spring loaded electrode pair is configured to deploy based on input from a pressure sensor.

15. The system of claim 1, wherein the electrical weapon system comprises a harness that is worn by the user, wherein the harness connects the control electronics to a plurality of electrodes located at a plurality of distinct points on the user.

16. The system of claim 15, further comprising a resistance measurement sensor configured to determine a respective resistance for each of a plurality of possible electrode pairs of the plurality of electrodes, and wherein the control electronics are further configured to select two of the plurality of electrodes as the electrode pair for delivering the voltage having the desired voltage level and modulation based on the resistances determined by the resistance measurement sensor.

17. The system of claim 1, wherein the control electronics comprise a plurality of capacitors, and wherein the control electronics is configured to connect a second charged capacitor to the electrode pair after discharging a first capacitor across the electrode pair.

* * * * *